US006275670B1

(12) United States Patent
Cho et al.

(10) Patent No.: US 6,275,670 B1
(45) Date of Patent: Aug. 14, 2001

(54) LIQUID ELECTROPHOTOGRAPHIC PRINTER HAVING EXHAUST DEVICE

(75) Inventors: Min-su Cho, Icheon; Woo-chul Jung, Yongin, both of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/473,706

(22) Filed: Dec. 29, 1999

(30) Foreign Application Priority Data

Jan. 29, 1999 (KR) ..... 99-2896

(51) Int. Cl.[7] ..... G03G 21/20
(52) U.S. Cl. ..... 399/92; 399/93
(58) Field of Search ..... 399/92, 93

(56) References Cited

U.S. PATENT DOCUMENTS 5,946,528 * 8/1999 Cho ..... 399/93

FOREIGN PATENT DOCUMENTS 56-69746 11/1979 (JP) .
63-158576 7/1988 (JP) ..... G03G/15/02
2-253289 10/1990 (JP) ..... G03G/21/00
2-273764 11/1990 (JP) ..... G03G/15/02
08-314337 11/1996 (JP) ..... G03G/21/00
10-20724 * 1/1998 (JP) .

* cited by examiner

*Primary Examiner*—Quana M. Grainger
(74) *Attorney, Agent, or Firm*—Sughrue, Mion, Zinn Macpeak & Seas, PLLC

(57) ABSTRACT

A liquid electrophotographic printer having topping corona devices for charging a photosensitive belt, a laser scanner for forming an electrostatic latent image on the charged photosensitive belt, and a development unit for developing the electrostatic latent image to an image having a predetermined color. The liquid electrophotographic printer includes an exhaust guide forming a movement path of air so that the air moves from places around the topping corona devices to the outside of the printer, a filter for filtering impurity contained in the air passing through the exhaust guide, and an induction pump for allowing air to flow from the places around the topping corona devices to the filter through the exhaust guide. The ozone generated around the topping corona devices can be removed, thereby preventing the environment surrounding the printer from being contaminated by the ozone.

2 Claims, 2 Drawing Sheets

LIQUID ELECTROPHOTOGRAPHIC PRINTER HAVING EXHAUST DEVICE

BACKGROUND OF THE INVENTION

1. Field of the Invention

The present invention relates to a liquid electrophotographic printer, and more particularly, to a liquid electrophotographic printer which can remove ozone generated therein.

2. Description of the Related Art

A liquid electrophotographic printer such as a color laser printer, as shown in FIG. 1, includes a photosensitive belt 1 making circular movement along an endless track, a topping corona device 2 for charging the photosensitive belt 1 into a predetermined potential, a laser scanner 3 for irradiating laser onto the charged photosensitive belt 1 to form an electrostatic latent image, a development unit 4 for developing the electrostatic latent image to an image having a predetermined color, and a transfer unit 5 for printing the developed image on a sheet of paper S. Thus, as printing proceeds, the topping corona device 2 charges the photosensitive belt 1 into a predetermined potential and the laser scanner 3 irradiates laser onto the charged photosensitive belt 1 to form the electrostatic latent image. The development unit 4 develops the electrostatic latent image to then be printed on the sheet S by the transfer unit 5. Reference numeral 6 represents a drier for drying the image developed on the photosensitive belt 1 to be suitable for the printing operation.

The topping corona device 2 charges the photosensitive belt 1 in a non-contact type using a discharge phenomenon. Thus, in the case of the discharge of the topping corona device 2, the oxygen contained in the ambient air may be turned into ozone $O_3$. If a large amount of ozone is generated, some of the generated ozone may be effused to the outside of the printer, causing environmental contamination. Therefore, there is increasing demand for printers which can remove ozone.

SUMMARY OF THE INVENTION

To solve the above problem, it is an objective of the present invention to provide a liquid electrophotographic printer with an improved structure which can remove ozone generated within the printer.

Accordingly, to achieve the above objective, there is provided a liquid electrophotographic printer having topping corona devices for charging a photosensitive belt, a laser scanner for forming an electrostatic latent image on the charged photosensitive belt, and a development unit for developing the electrostatic latent image to an image having a predetermined color, the liquid electrophotographic printer including an exhaust guide forming a movement path of air so that the air moves from places around the topping corona devices to the outside of the printer, a filter for filtering impurity contained in the air passing through the exhaust guide, and an induction pump for allow air to flow from the places around the topping corona devices to the filter through the exhaust guide.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
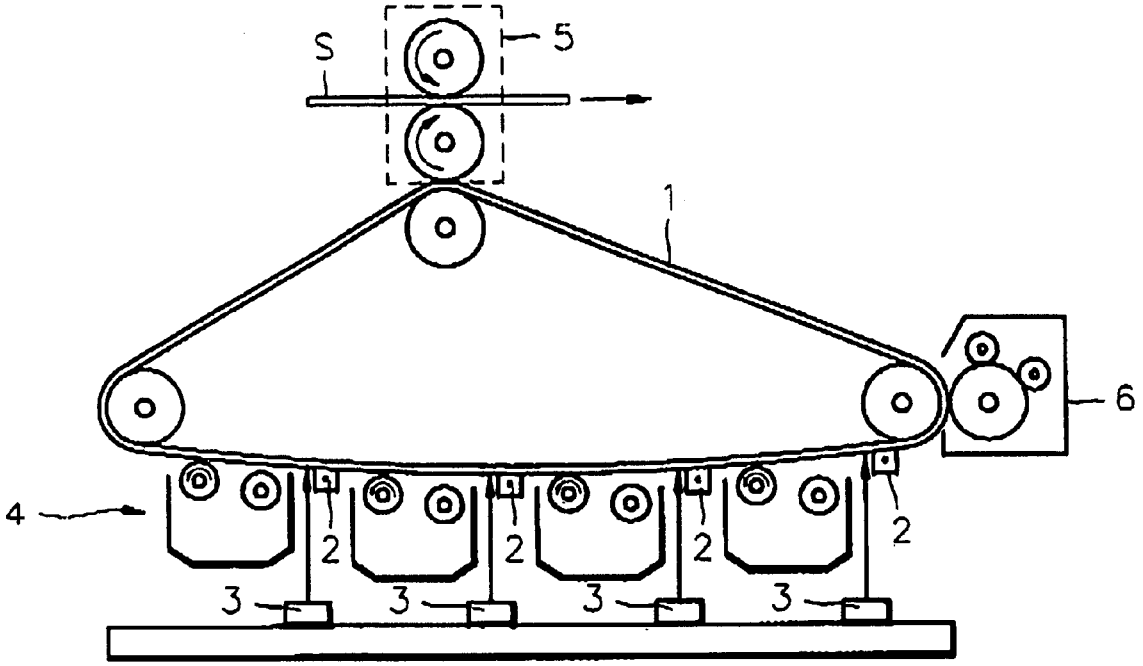
FIG. 1 (PRIOR ART)
FIG. 1 is a schematic diagram illustrating the internal structure of a conventional liquid electrophotographic printer.
Figure 2:
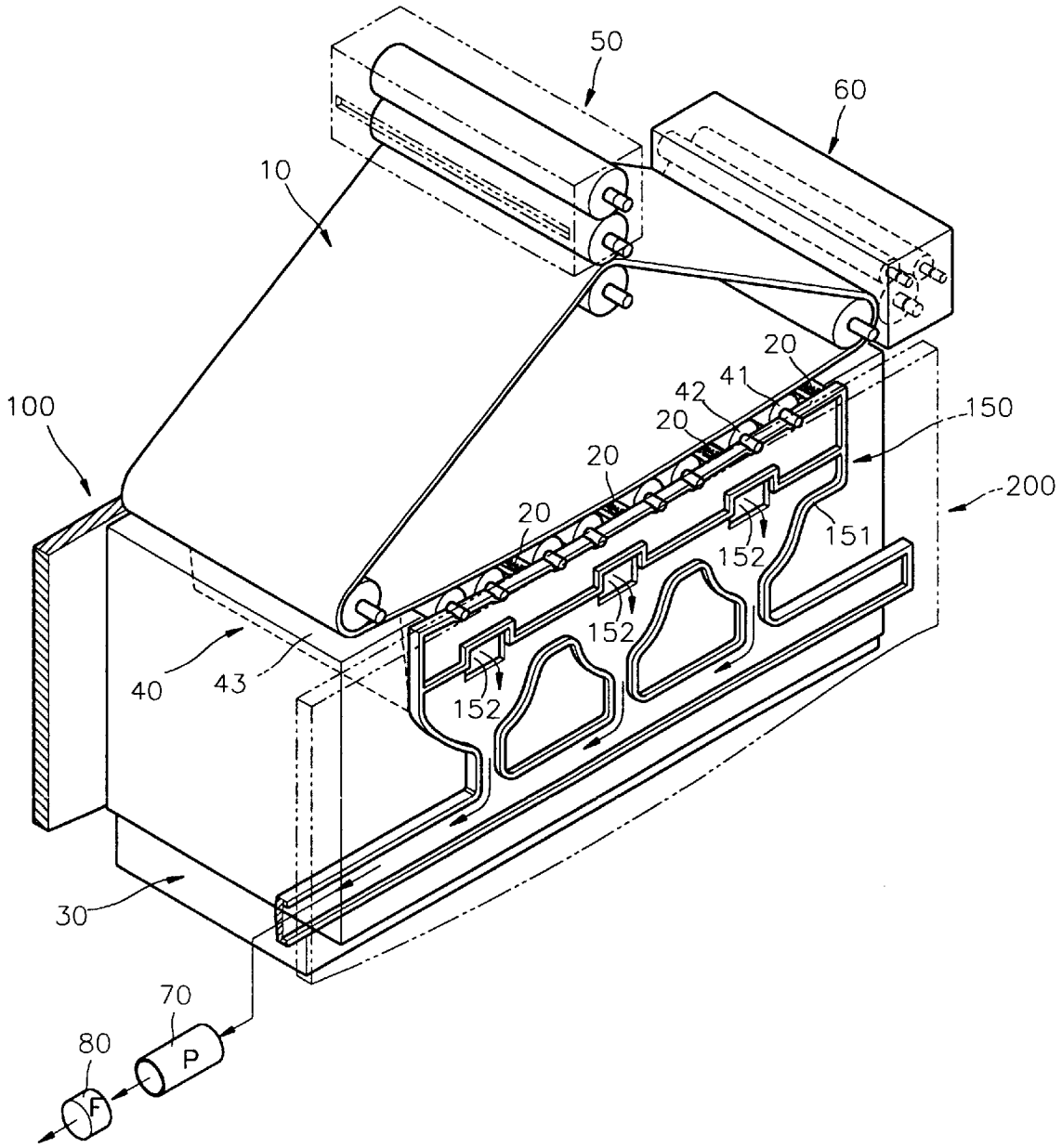
FIG. 2 is a schematic diagram illustrating the internal structure of a liquid electrophotographic printer according to the present invention.

Referring to FIG. 2, in the lower portion of a photosensitive belt 10, there are provided topping corona devices 20 for charging the photosensitive belt 10, a laser scanner 30 for forming an electrostatic latent image on the charged photosensitive belt 10, and a development unit 40 for developing the electrostatic latent image to an image having a predetermined color. The development unit 40 includes a development tank 43, and developing rollers and squeegee rollers installed within the development tank 43. Reference numerals 100 and 200 represent a front frame and a rear frame installed in front of and in rear of the printer, respectively. A supporting frame 150 for supporting the development unit 40 including the respective rollers 41 and 42 is installed between the rear frame 200 and the development unit 40. Throughholes 152 are formed next to the topping corona devices 20 in the supporting frame 150. A flange 151 surrounding the throughholes 152 and contacting the rear frame 200 protrudes toward the rear frame 200 so that a hollow path is formed in the inner space closed by the flange 151. In other words, the supporting frame 150 is fixed on the rear frame 200, thereby forming the inner space closed by the flange 151. The inner space functions as an exhaust guide for guiding the air to move from the places around the topping corona devices 20 to the outside of the printer. An induction pump 70 is installed so that the air is induced through the inner space. The air induced by the induction pump 70 is exhausted via a filter 80 provided at the exit side. As the filter 80, an adsorptive filtering medium such as charcoal is preferably used. Reference numeral 60 represents a drier for drying the image developed on the photosensitive belt 10.

When the printing operation is carried out, as described above, the topping corona devices 20 charge the photosensitive belt 10, and the laser scanner 30 irradiates laser to form an electrostatic latent image. The electrostatic latent image is developed by the development unit 40 to then be printed on the printing paper by the transfer unit 50. As indicated by the arrows in FIG. 2, the induction pump 70 induces the air from the throughholes 152 via the hollow path formed between the supporting frame 150 and the rear frame 200 and transmits the induced air toward the filter 80. Accordingly, the ozone generated around the topping corona devices 20 is discharged toward the filter 80 along the air flow. The ozone is adsorbed into the filter 80 in the course of passing through the same to then be filtered. Only the filtered air is exhausted to the outside of the printer. Therefore, the ozone generated by the discharge of the topping corona devices 20 is induced to the filter 80 along the exhaust guide to then be removed.

As described above, according to the liquid electrophotographic printer of the present invention, the ozone generated around topping corona devices is removed, thereby preventing the environment surrounding the printer from being contaminated.

What is claimed is:

1. A liquid electrophotographic printer having topping corona devices for charging a photosensitive belt, a laser scanner for forming an electrostatic latent image on the charged photosensitive belt, and a development unit for developing the electrostatic latent image to an image having a predetermined color, the liquid electrophotographic printer comprising:

an exhaust guide for the movement of air so that air moves firm an area near the topping corona devices to the outside of the printer;

a filter for filtering impurity contained in the air moving through the exhaust guide; and an induction pump for pumping air through the exhaust guide, from the area near the topping corona devices to the filter, wherein the exhaust guide is a hollow path formed between a supporting frame for supporting the development unit and a rear frame on which the supporting frame is fixed, and wherein the supporting frame has throughholes for allowing air to move into the exhaust guide.

2. The liquid electrophotographic printer according to claim 1, wherein the filter is charcoal.

* * * * *